US005193514A

United States Patent [19]

Kobayashi et al.

[11] Patent Number: 5,193,514

[45] Date of Patent: Mar. 16, 1993

[54] INDUCTION DISCHARGE TYPE IGNITION DEVICE FOR AN INTERNAL COMBUSTION ENGINE

[75] Inventors: Ryouichi Kobayashi, Tokai; Noboru Sugiura, Mito; Noriyoshi Urushiwara, Katsuta, all of Japan

[73] Assignee: Hitachi, Ltd., Tokyo, Japan

[21] Appl. No.: 726,824

[22] Filed: Jul. 8, 1991

[51] Int. Cl.[5] ..... F02P 3/02

[52] U.S. Cl. ..... 123/634

[58] Field of Search ..... 123/598, 604, 606, 620, 123/634, 635; 336/96

[56] References Cited

U.S. PATENT DOCUMENTS

| | | | |
|---|---|---|---|
| 3,824,977 | 7/1974 | Campbell et al. | 123/651 |
| 4,662,343 | 5/1987 | Smith | 123/634 X |
| 4,677,960 | 7/1987 | Ward | 123/598 |
| 4,774,914 | 10/1988 | Ward | 123/620 X |
| 4,903,674 | 2/1990 | Bassett et al. | 123/634 |

OTHER PUBLICATIONS

Ingenieurs De L'Automobile, No. 7, Oct. 1984, Boulogne Fr pp. 53–60; Golvan M. J.: "Electronique Automobile, Realites Et Promesses (Lere Partie)", *p. 57, Left Column, Line 24–Line 44*.

*Primary Examiner*—Willis R. Wolfe
*Attorney, Agent, or Firm*—Ladas & Parry

[57] ABSTRACT

An induction discharge system ignition device for an internal combustion engine includes a power switching device for producing a voltage to be applied to the primary winding of an induction coil. The secondary of the induction coil is connected to apply a high-tension voltage to a spark plug. The power switching device and the coil are particularly arranged to produce a voltage of at least 6.0 kV across the electrodes of the spark plug when the spark plug has a leakage of 100 kΩ. The turns ratio of the coil is, preferably, 70 or less.

12 Claims, 8 Drawing Sheets

Spark plug electrode voltage applied to spark plug $V_2^1$ (kV) in the smoldering condition at low temperature of about -30°C 2000 rpm A/F = 13.0

3000 rpm A/F = 12.6

4000 rpm A/F = 12.0

5000 rpm A/F = 11.3

6000 rpm A/F = 10.8

7000 rpm A/F = 10.2

INDUCTION DISCHARGE TYPE IGNITION DEVICE FOR AN INTERNAL COMBUSTION ENGINE

BACKGROUND OF THE INVENTION

1. Field of the Invention

This invention relates to an ignition device for an internal combustion engine, and more particularly to a so-called "induction discharge type" ignition device which causes a spark at a spark plug induced by a high voltage in a secondary coil of an ignition coil when a current flowing through the primary coil of the ignition coil is cut off by a semiconductor power switching device.

2. Description of the Related Art

The invention in Japanese Patent Laid-Open No. 112630/1975 discloses that in induction discharge type ignition devices, the turns ratio of the primary winding to the secondary winding of the ignition coil must be made small and the inductance value on the side of the primary coil must be made sufficiently great in order to make the rise of the voltage occurring at the spark plug very steep and, moreover, to maintain the arc discharge over a long time period.

The secondary coil voltage $V_2'$ at the time of load is proportional to $V_z$ (breakdown voltage of the semiconductor power switching device) multiplied by the coil turns ratio a. Typically, $V_2'$ is 28 kV for a clean spark plug and the turns ratio, a is typically 85 to 100. However, there is a conflict since, because $V_2'$ is required to be high and the turns ratio, a, is required to be as low as possible, the semiconductor breakdown voltage $V_z$ is required to be increased but, as will be appreciated by those skilled in the art, there is a hardware limit as to how high the breakdown voltage can be made. Currently, the upper limit for the semiconductor power switching device, usually a Zener diode, is 400 V.

There is a further difficulty in that when the plug is in a smoldering condition, that is when the spark plug insulation is carbonised and wetted by gasoline, then there is breakdown between the outer, curved electrode and the insulation. The leakage path between the insulation and the curved outer electrode, for a clean spark plug, should, theoretically, be infinity, but is typically 10MΩ. However, when a spark plug is in the smoldering condition at low temperature of about −30° C., the leakage resistance drops to about 100 kΩ, which means that breakdown between the outer curved electrode and the insulation can occur at a voltage much lower than the normally operated 28 kV. It is believed to be a fundamental finding of the present applicants that the leakage resistance of the spark plug is in the range 100 kΩ to 10MΩ (effectively infinity).

There is a further problem that is encountered in the prior art that when an engine rotates at high speed, the spark generated between the outer curved electrode and the central electrode of the spark plug, the spark is blown out, that is briefly extinguished, by the stream of air-fuel mixture sucked into the cylinder. Thus, normal ignition is not effected during high speed revolutions of the engine. The present invention seeks to overcome the foregoing disadvantages associated with the prior art.

SUMMARY OF THE INVENTION

According to this invention there is provided an induction discharge system ignition device for an internal combustion engine including means for producing a voltage to be applied to a coil primary winding, means for applying an output of said coil to a fuel ignition means, and means for producing a voltage of at least 6.0 kV across the electrodes of the ignition means when said ignition means has a leakage resistance of 100 kΩ.

The applicants have made the following fundamental findings:

1. That the leakage resistance of a spark plug from the outer curved electrode to the insulator is in the range 100 kΩ to 10MΩ and that in the prior art the voltage $V_2'$ applied to the electrodes of the spark plug (hereinafter referred to as spark plug electrode voltage), at the time of load for a 100 kΩ leakage, is approximately 5 kV.

2. That for high performance of sparking $V_2'$ across 100 kΩ must be greater than 6 kV.

Therefore, the present invention produces the spark plug electrode voltage $V_2'$ at the time of load of at least 6 kV even when the leakage resistance is 100 kΩ and to achieve these requirements the semiconductor switching device has a switch ON, for example Zener voltage, of at least 350 V and the coil has a turns ratio a to provide $V_2'$ of 6 kV into a 100 kΩ load.

Preferably, the means for producing the voltage of at least 6.0 kV across the spark plug electrodes includes a predetermined turns ratio of secondary to primary windings of the coil and, advantageously, the turns ratio is 70 or less. When the turns ratio is 70 and the voltage producing means provides a voltage of at least 350 V across the reduced to a minimum necessary level to maximise the secondary current which exerts a strong influence on low temperature startability and the forementioned blow-out of the ignition spark.

In a preferred embodiment, the turns ratio of the ignition coil is the square root of the secondary winding inductance divided by the primary winding inductance.

By using the construction described above, the probability of obtaining a normal spark becomes higher even when a spark plug is in the smoldering state due to contamination or damp because the lowest spark plug electrode voltage $V_2'$ is set on the assumption of such a smoldering state. Such a construction also makes the peak value of the secondary current with respect to the maximum value of the primary current large and the possibility of blow-out of the spark by the flow of the mixed gas becomes lower even when the engine operates in a high speed revolution range.

BRIEF DESCRIPTION OF THE DRAWINGS

The invention will now be described, by way of example, with reference to the accompanying drawings in which.

In the Figures like reference numerals denote parts.

DESCRIPTION OF PREFERRED EMBODIMENT

Before describing an embodiment of the present invention, the fundamental findings of the applicants will be initially outlined.

Figure 1:
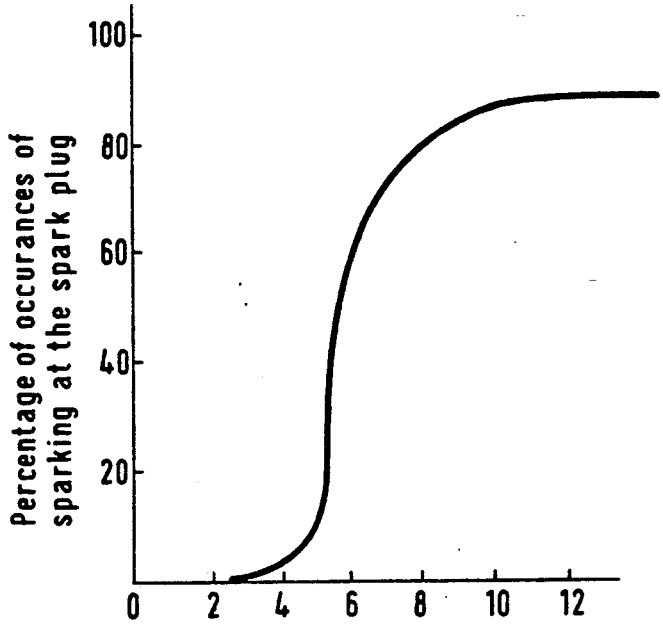
FIG. 1 is a graphical representation indicating the percentage of ignition depends on the voltage $V_2'$ applied to a spark plug in the smoldering condition at low temperature of about −30° C.

Referring to FIG. 1, the graph shown therein indicates the percentage of occurrence of sparking at the spark plug with increasing spark plug electrode voltage $V_2'$ applied to the spark plug from which it will be noted that to achieve sparking approximately 90% of the time an induced voltage is applied to the spark plug, a spark plug electrode voltage $V_2'$ of 10 kV or greater is required. For production of sparking, in excess of 60% of the time, which is considered by the applicants to be the minimum efficiency required, a secondary voltage of 6 kV is necessary.

Figure 2:
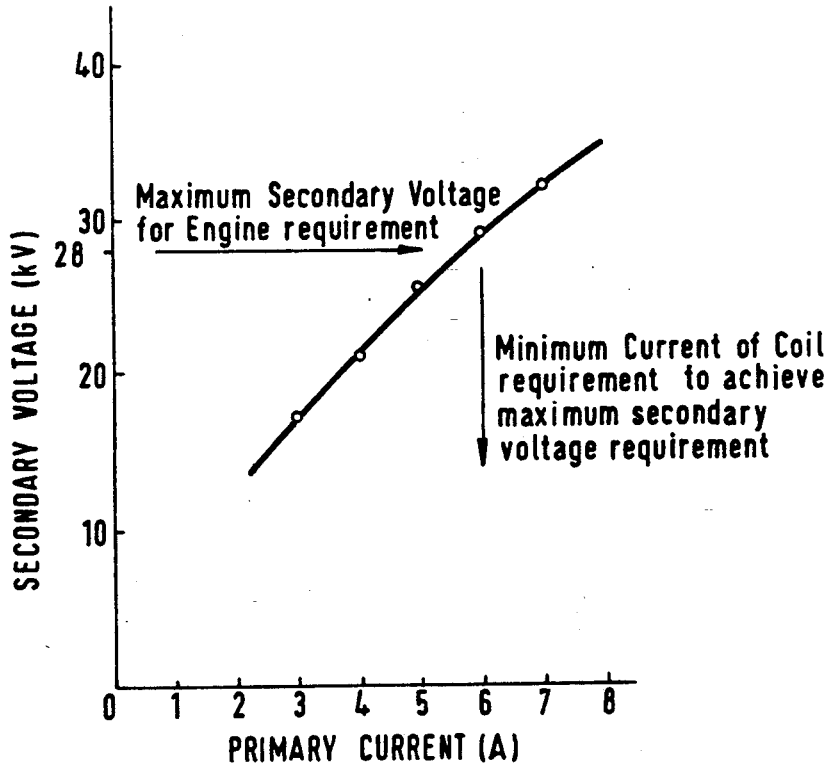
FIG. 2 shows the induction coil secondary voltage versus primary current characteristic.

The graphical characteristic shown in FIG. 2 of secondary voltage against primary current indicates that for a clean spark plug the maximum secondary voltage for the engine (determined by the spark plug gap, ignition retarded and an air-fuel ratio which is lean) indicates that at a secondary voltage of 28 kV a primary coil current of approximately 6 amps is required. Thus, to achieve the maximum secondary voltage requirement of the engine, a minimum current of 6 amps is required to be applied to the primary coil.

Figure 3:
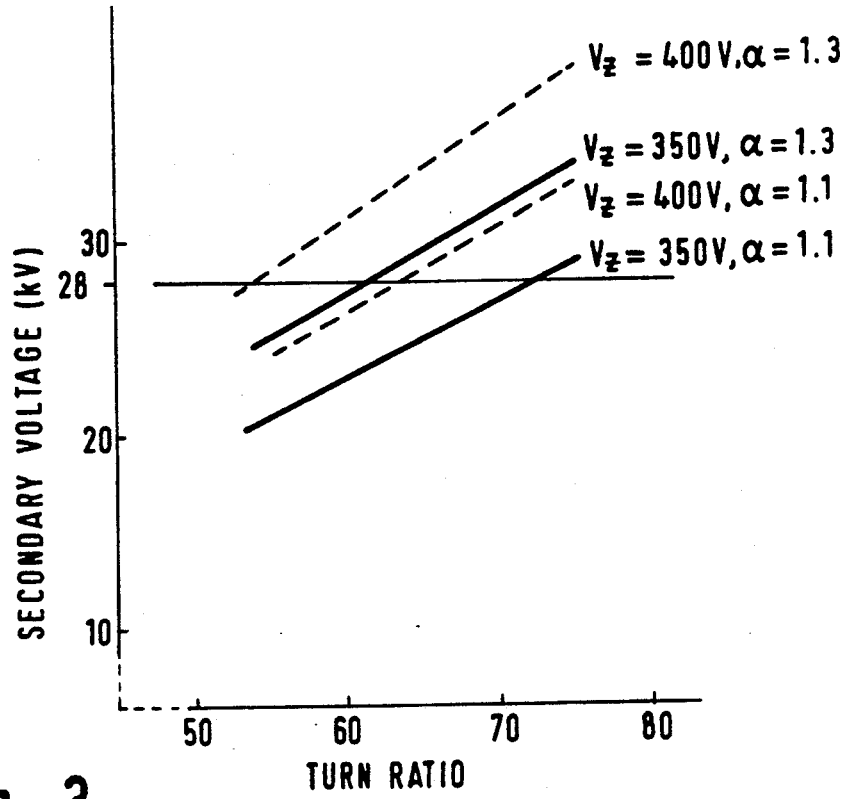
FIG. 3 shows the induction coil secondary voltage versus turns ratio characteristics.

So as to determine the turns ratio of the induction coil under normal operating conditions, that is with a clean spark plug, the applicants derived the graphical representation shown in FIG. 3 where secondary voltage is presented against turns ratio of the induction coil. The graphs indicate differing Zener voltages $V_z$ for different load coefficients $\alpha$, the load coefficient being required to be as close to unity as possible for good efficiency of the coil, that is so that low heat production is produced in the coil in conversion of voltage from the primary coil to the secondary coil, (that is $V_1$ to $V_2$). The graph shown in FIG. 3 indicates that if the secondary voltage is approximately 28 kV then $V_z$ should be in the range 350 V-400 V and the lowest practicable load coefficient is 1.1 so that the turns ratio is 70.

Figure 4:
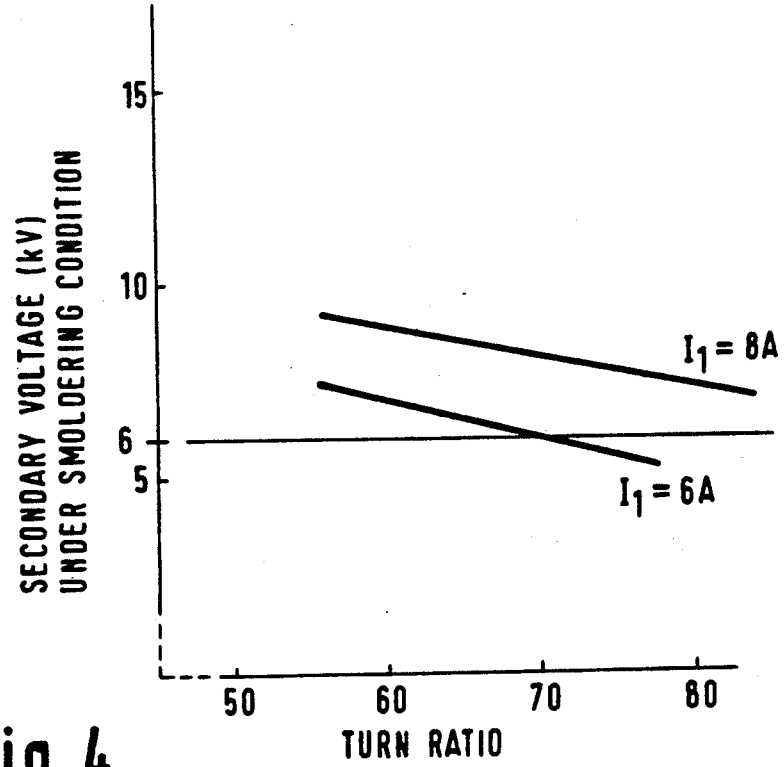
FIG. 4 shows the induction coil secondary voltage versus turns ratio characteristics with a spark plug under smoldering conditions.

In FIG. 4, the characteristic of turns ratio and the spark plug electrode voltage $V_2'$ is shown under smoldering spark plug conditions, that is into a load of 100 kΩ and 25 pF for differing values of primary current. From FIG. 1 it was found that, at the time of smoldering, a spark plug electrode voltage $V_2'$ of at least 6 kV was required, and from FIG. 2 it was found that a primary current of 6 amps was desirable. Therefore for the primary current of 6 amps a turns ratio of 70 is required which, also approximates to the turns ratio under normal conditions is shown in FIG. 3.

Thus, by the foregoing findings of the applicants, data for the device of the present invention was derived.

An embodiment of the present invention is applied to a so-called "direct ignition system" (DIS) wherein ignition energy is directly supplied from a plurality of ignition coils to each of a like plurality of cylinders without using a distributor will be explained with reference to FIG. 5. In the exemplary embodiment a six-cylinder engine is assumed.

Each ignition coil 11-16 has a primary coil 21-26 and a respective secondary coil 31-36 supplying H. T. to a respective spark plug $P_1$ to $P_6$. One end of each primary coil 21-26 is connected to a battery BT; the other end of the each primary coil is connected to a Darlington pair of transistors 41-46 provided for driving the ignition coil.

Each Darlington pair of transistors 41-46 consists of two transistors $T_1$, $T_2$ connected in the Darlington configuration with resistors $R_1$, $R_2$ between respective transistor base and emitter electrodes. An ignition signal is applied from a drive circuit DC to the base of the transistor $T_1$ through a terminal $a_3$-$f_3$ and a resistor $R_3$. A Zener diode $Z_D$ is interposed between the collector and base of the transistor $T_1$ of each Darlington pair of transistors 41-46. A reverse biased diode D is connected between the collector and emitter of the transistor $T_2$. A current limiting circuit $IL_1$-$IL_6$ is connected between the emitter of the transistor $T_2$ and the collector of the transistor $T_1$ so that a current flowing through the collector-emitter circuit of each Darlington pair of transistors 41-46 can be set at a predetermined value (8A in this embodiment with a turns ratio of 65) within the range where the Darlington pair of transistors 41-46 is not thermally destroyed. The devices encompassed by broken lines are formed on one semiconductor layer and constitute a one-chip power switch $P_{SW1}$-$P_{SW6}$. These power switches $P_{SW1}$-$P_{SW6}$ are bonded and arranged together on one substrate PL to constitute a power module $P_{SW}$.

On the power module $P_{SW}$ are formed connection terminals $a_2$-$f_2$ for connecting the collectors of each Darlington pair of transistors 41-46 of the power switch $P_{SW1}$-$P_{SW6}$ to the primary coils 21-26 of the respective ignition coils 11-16, connection terminals $a_3$-$f_3$ for connecting the drive circuit DC which supplies the ignition signal to the base of the first-stage transistor $T_1$ of each Darlington pair of transistors 41-46 and a ground terminal GR for grounding the power switch $P_{SW1}$-$P_{SW6}$. $a_1$-$f_1$ represent the junctions between the power source line and the ignition coils 11-16.

A microcomputer engine control unit (ECU) for receiving and analysing engine operating parameters is connected to the drive circuit DC and a fuse F and key switch $K_{SW}$ are serially connected between the battery BT and the coils 11-16.

In operation, the rotational angle $\theta$ of the engine crank shaft (not shown) is detected by a crank angle sensor and is inputted sequentially into the engine control unit ECU.

The air quantity Qa sucked into the engine is detected by, for example, a conventionally known heat ray type air flow rate sensor (not shown in FIG. 1) and is inputted into the ECU.

The warming-up condition of the engine is determined from the cooling water temperature Tw, and is detected by a water temperature sensor and similarly inputted into the ECU.

Whether or not the engine is idling is detected by an idling switch $I_{SW}$ disposed in a throttle valve (not shown) and is also inputted into the ECU so as to adjust the ignition timing of the engine to the optimum advance angle position, the knocking state of the engine is detected by a knock sensor KNO, and inputted into the ECU. Furthermore, the mixing ratio of air and fuel that governs the combustion state of the engine is determined by the oxygen $O_2$ concentration in the exhaust gas, which is detected by an oxygen concentration sensor fitted in an exhaust manifold (not shown in FIG. 1), and is similarly inputted into the ECU.

Figure 5:
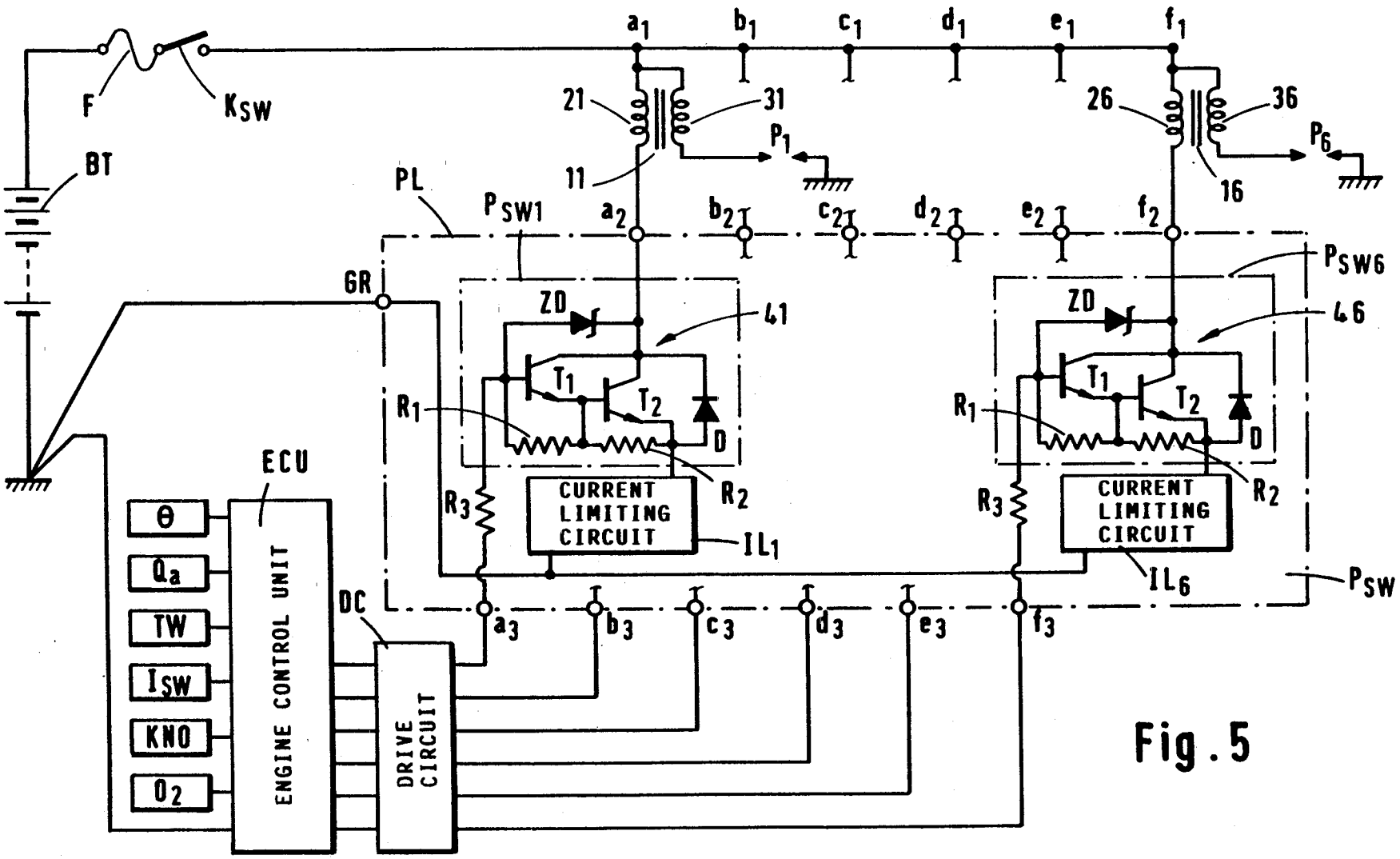
FIG. 5 shows a circuit diagram of an induction discharge type ignition device in accordance with this invention in which the device is shown in detail for one plug and one system.

From the inputted information, the ECU calculates the quantity of fuel supplied, the ignition timing and the power feed time to the primary coils that are optimal for the engine operation, and controls the fuel injection valves (not shown) and the ignition device shown in FIG. 5.

The ignition timing and the power feed time signal to the primary coils are calculated for each cylinder.

The basic ignition timing is calculated in terms of the number of revolutions of the engine and this number of revolutions is determined from the number of counted crank angle signals $\theta$ per unit time. The crank angle sensor outputs a reference cylinder signal and a cylinder discrimination signal and an advance angle reference point is set for each cylinder in accordance therewith.

The basic ignition timing is corrected by at least one of intake air quantity $\theta$, the water temperature Tw, the signal $I_{sw}$ representing the state of the idle switch, the signal KNO representing the knocking state of the engine and the oxygen concentration $O_2$. This correction is effected by adding the correction value read for each signal from an ignition timing correction map provided for each signal to the basic ignition timing.

Similarly, the power feed time is also calculated and corrected for each cylinder and is supplied to the ignition device with the ignition timing signal through the drive circuit DC.

When the power supply time of the ignition device of the first cylinder is determined as described above, the output terminal of the drive circuit DC connected to the connection terminal $a_3$ rises to a High level before the arrival of the ignition timing signal. Therefore, a current flows through the base of the first-stage transistor $T_1$ of the Darlington pair of transistors 41 through the resistor $R_3$. This current is amplified by the amplification factor $h_{fe}$ of the transistor $T_1$ and is supplied to the base of the transistor $T_2$ through the collector-emitter of the transistor $T_1$. The current which is amplified by the amplification factor $h_{fe}$ of the transistor $T_2$ flows further through the collector-emitter of the transistor $T_2$.

Since this current flows through the primary coil 21 of the ignition coil 11 through the fuse F and the key switch Ksw, it is referred to as a "primary current". This primary current increases to a predetermined value, that is, 8A in the present example, in accordance with the rise characteristics which will be described hereinafter.

The value of this primary current is not always 8A. The primary coil of the ignition coil has a resistance value which is dependent on its ambient temperature. Therefore, when an ignition device is desired, it is customary to examine in advance how much the resistance value of the coil rises under the temperature condition where the ignition device is located in the engine and to determine the current to be supplied o the bases of the Darlington pair of transistors 41–46 or to determine the amplification factor of the Darlington pairs of transistors on the basis of the resistance value at that time.

The reason is that if the primary current is determined on the basis of a low resistance value of the coil at ambient temperature, the resistance value of the ignition coil becomes high when the temperature of the ignition coil rises as the engine reaches its normal operational state, so that a desired current does not flow through the primary coil.

If the primary current is insufficient, ignition energy becomes insufficient and ignition becomes impossible.

As described above, the design is so made that the primary current of 8A flows when the engine has reached its normal operating temperature and the resistance value of the ignition coil is relatively high. Therefore, when the resistance value of the ignition coil is small, that is, the engine temperature is not sufficiently high and the ignition coil is cold, there may be the situation where the primary current exceeds 8A. In such a case, the Darlington pair of transistors may generate heat abnormally due to the over-current, resulting in breakdown.

Therefore, current limiting circuits $IL_1$–$IL_6$ are provided. The current limiting circuits detect the primary current, operate when primary current above 8A flows, decrease the input current to the Darlington pairs of transistors and prevent the primary current from rising.

When the primary current flows through the primary coil in the manner described above, energy for the ignition is stored in the primary coil.

After the calculated power supply time passes, the ignition timing signal is outputted. The ignition timing signal is applied through the drive circuit as a signal which lowers the potential of the connection terminal $a_3$ to a Low level.

When the input current of the Darlington pair of transistors 41 is cut off by the ignition timing signal, the primary current is cut off instantaneously and a high voltage having a sharp rise occurs in the secondary coil 31 of the ignition coil 11 due to electromagnetic induction.

The voltages induced in the primary and secondary coils at this time are referred to as the "primary voltage" and the "secondary voltage", respectively, and they have a relationship which will be described hereinafter.

The principle of the present invention will be further described with reference to FIG. 6 which shows an equivalent circuit of the ignition device for one of the engine cylinders.

Figure 6:
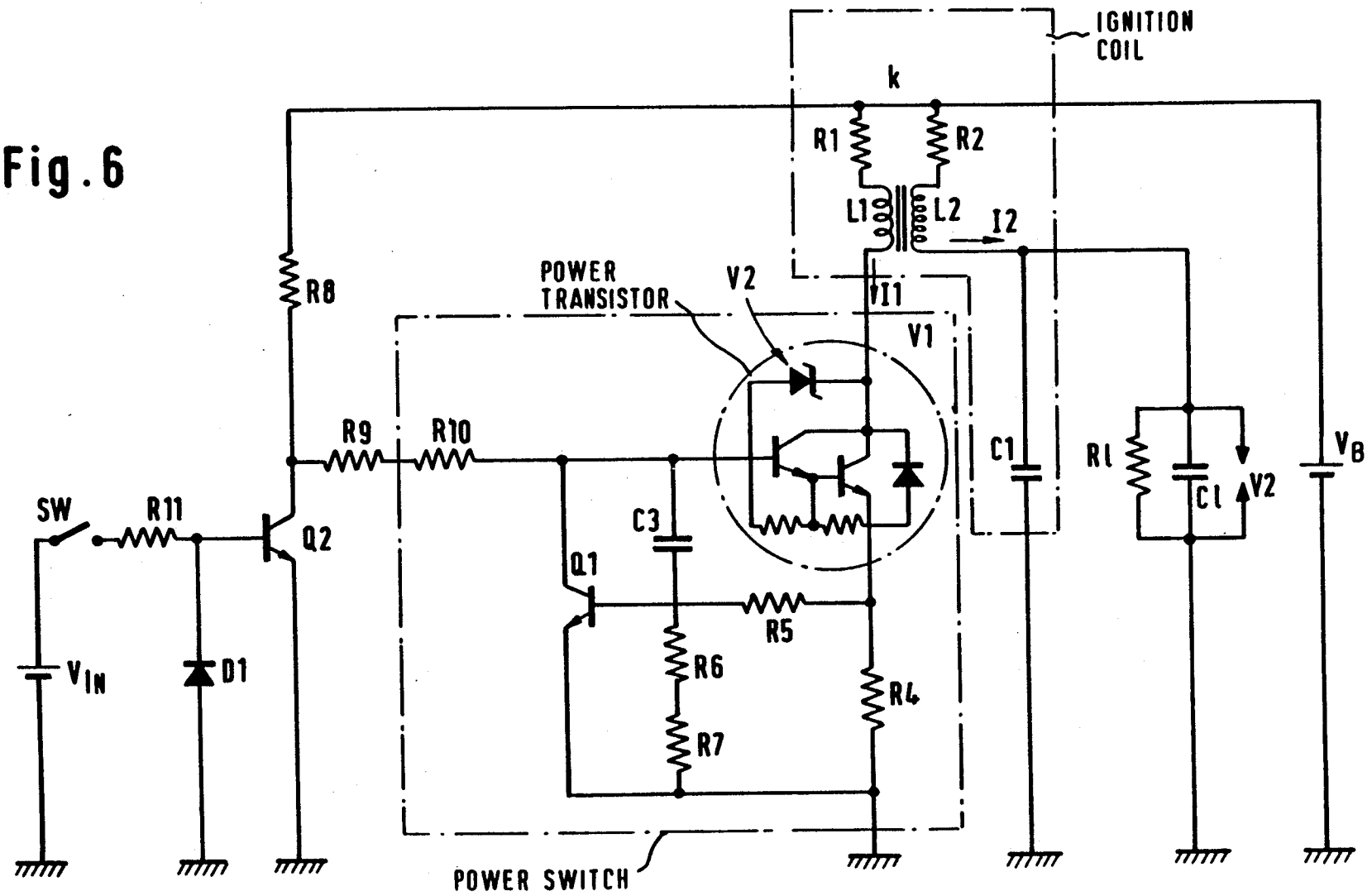
FIG. 6 shows an equivalent circuit diagram of the ignition device shown in FIG. 5.

In FIG. 6 the symbols have the following meaning:

$V_1$:primary voltage
$V_2$:secondary voltage
$I_1$:primary current
$I_2$:secondary current
$V_Z$:Zener voltage
$R_1$:primary resistance
$L_1$:primary inductance
$R_2$:secondary resistance
$L_2$:secondary inductance
k:coupling coefficient between primary and, secondary coils
$C_2$:internal stray capacitance
$R_l$:load resistance
$C_l$:load capacitance $V_B$:battery voltage
$V_{IN}$:pulse signal
$N_1$:primary number of turns
$N_2$:secondary number of turns
a:turns ratio secondary coil:primary coil When the iron loss and the copper loss are neglected, the relation between the output characteristics of the ignition coil and the power switch characteristics can be expressed approximately by the following equations (1)-(5).

(a) Generated secondary voltage:

(i) When limitation by Zener voltage does not exist:

$$V2\alpha k\sqrt{\frac{L_1}{C_2 + C_L}} \cdot I_1 \quad (1)$$

(ii) When limitation by Zener voltage does exist:

$$V_2 \propto \alpha \cdot V_{Zmin} \cdot a \quad (1)$$

$\alpha$:load coefficient 1.1 to 1.3

(b) Secondary current:

$$I_2 \propto k\frac{N_1}{N_2} I_1 = k\frac{1}{a} I_1 = k\sqrt{\frac{L_1}{L_2}} I_1 \quad (3)$$

(c) Secondary energy:

$$E_2 \propto k^2 \tfrac{1}{2} L_1 \cdot I_1^2 \quad (4)$$

(d) Rise characteristics of primary current of ignition coil:

$$I_1 = \frac{V_B - V_{CE}}{R_1 + R_4}\left[1 - \exp\left(-\frac{R_1 + R_4}{L_1} t\right)\right] \quad (5)$$

where $V_{CE}$:collector-emitter voltage of power transistor

Here, the spark plug electrode voltage $V_2'$ of the ignition coil at the time of spark plug smoldering (at the time of load) with respect to the secondary output $V_2$ at the time of non-load can be expressed approximately by the following equation (6) from the equivalent circuit shown in FIG. 6.

When frequency of secondary voltage $V_2$ f=10 kHz, $1/\omega C_l$ is about 500KΩ and the load resistance $R_l$ at the time of smoldering is about 100 kΩ. Therefore, if $1/\omega C_l$ is neglected, the spark plug electrode voltage $V_2'$ at the time of load is given as follows:

$$V_2' \propto \frac{R_l}{\omega L_2 + R_2 + R_l} V_2 \quad (6)$$

where $\omega$ is angular frequency

Figure 7:
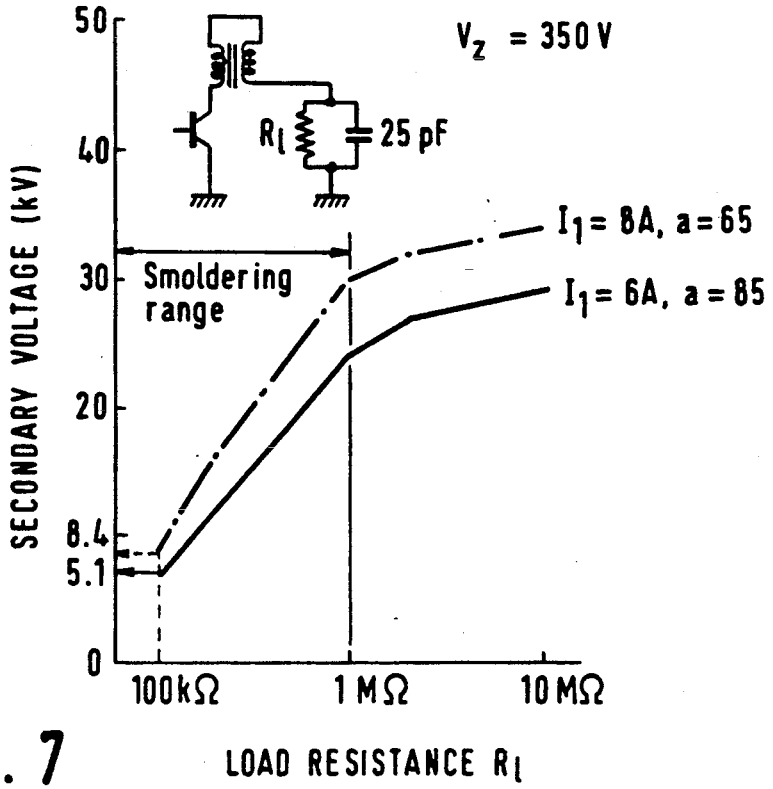
FIG. 7 shows a secondary voltage versus load resistance characteristic.

When $L_2$=15 H, the impedance of $L_2$ is given by $\omega L_2 \approx 2\pi \times 10$ kHz$\times$15 H$\approx$900 kΩ. The spark plug electrode voltage $V_2'$ drops greatly when the load resistance $R_l$ at the time of smoldering is about 100 kΩ. The graph shown in FIG. 7 indicates that with a $V_z$ of 350 V and a changing load resistance, the spark plug electrode voltage $V_2'$ drops greatly in the smoldering range, that is 100 kΩ to 1MΩ and the graphs show, in solid line, the characteristics for the prior art where $I_1$ is 6 amps and turns ratio a=85 and the present invention in chain-broken line where $I_1$=8 amps and a=65. Thus, the graph shows that $V_2$ needs to be above 6 kV at 100 KΩ for efficient operation of the device.

Figure 8:
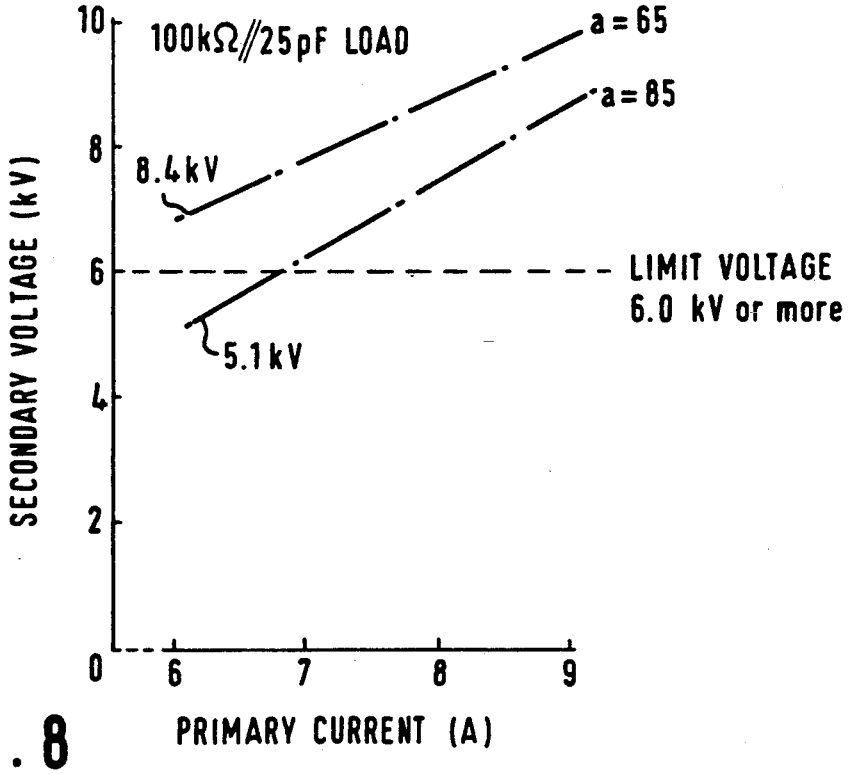
FIG. 8 shows a secondary voltage versus primary current characteristic for different induction coil turns ratios, FIGS. 9(*a*)-9(*f*) and 9(*g*)-9(*l*) show a series of graphical representations of the change of secondary voltage and secondary current characteristics in dependence upon the number of engine revolutions of the prior art and the present invention, respectively.
Figure 9A:
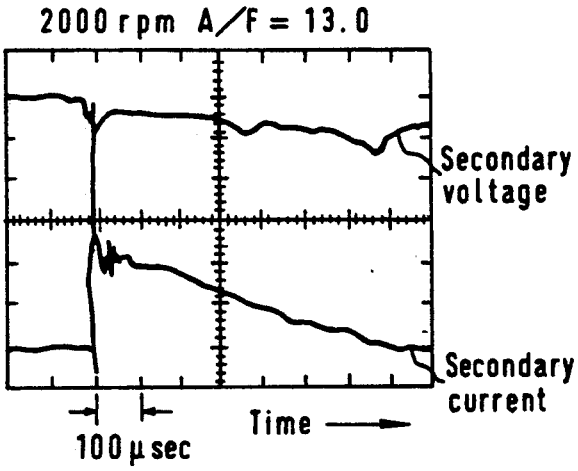
Fig.9(a) PRIOR ART
Figure 9B:
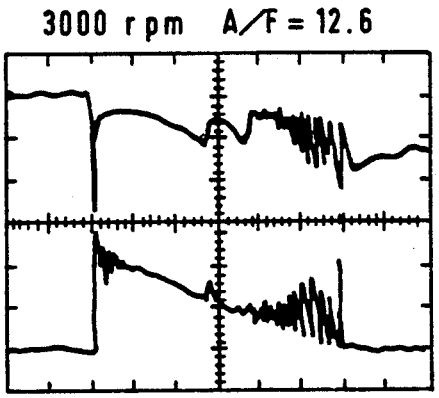
Fig.9(b) PRIOR ART
Figure 9C:
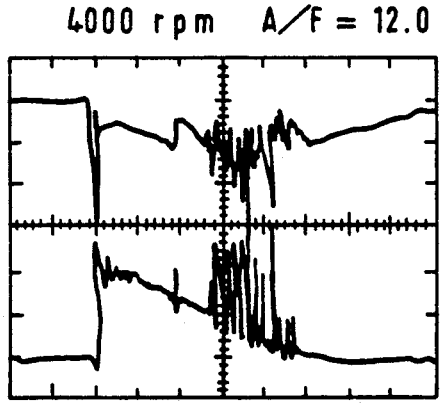
Fig.9(c) PRIOR ART
Figure 9D:
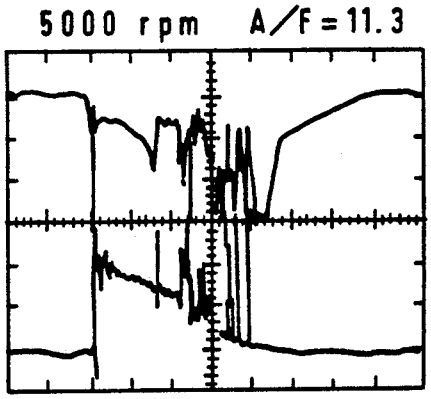
Fig.9(d) PRIOR ART
Figure 9E:
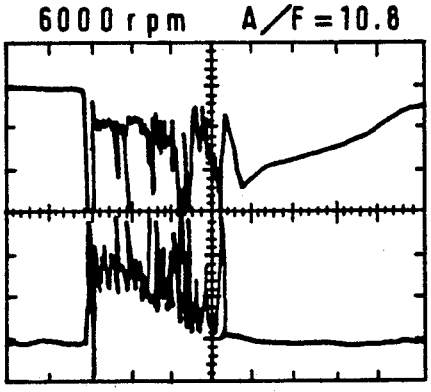
Fig.9(e) PRIOR ART
Figure 9F:
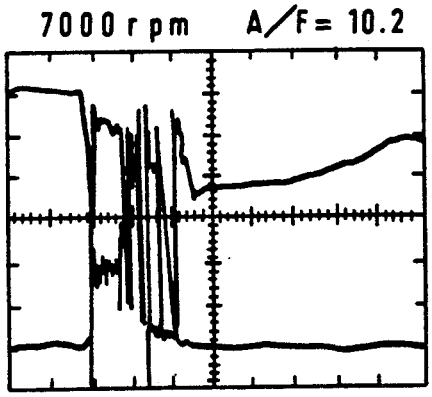
Fig.9(f) PRIOR ART
Figure 9G:
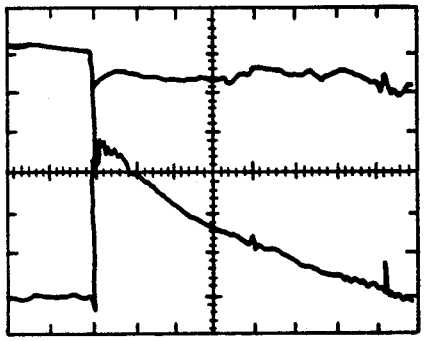
Figure 9H:
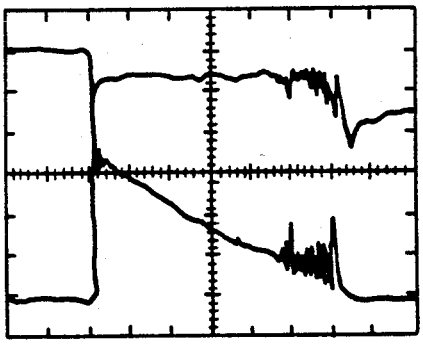
Figure 9I:
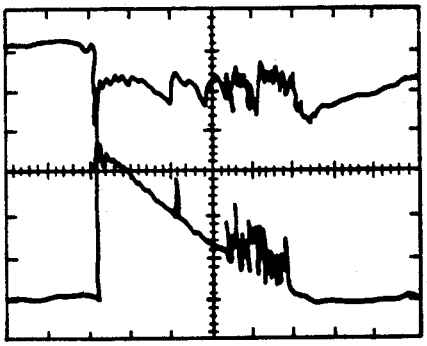
Figure 9J:
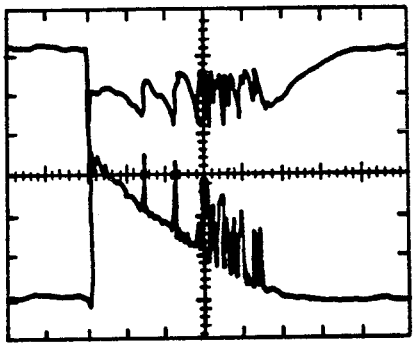
Figure 9K:
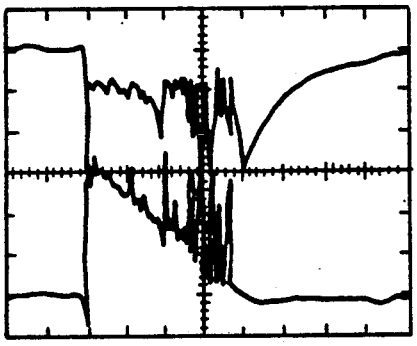
Figure 9L:
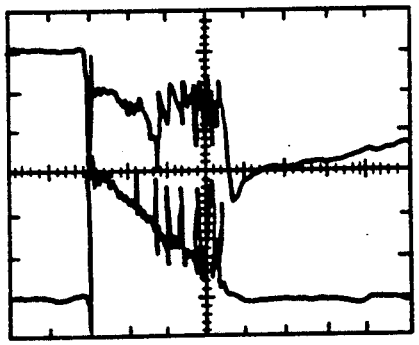

The present inventors conducted extensive experiments by connecting a 100 KΩ resistor in parallel with a normal ignition plug ($C_2$:25 pF) under various conditions to examine the spark generation condition and confirmed that the probability of the occurrence of the spark necessary for ignition dropped remarkably when the spark plug electrode voltage $V_2'$ was below 6.0 kV (as shown in FIG. 1). This is represented in another way in FIG. 8 wherein secondary voltage is plotted against primary current for differing turns ratio. In the present invention, the turns ratio a is 85 and in the prior art the turns ratio is typically 85. If the turns ratio is 70 or less then the spark plug electrode voltage $V_2'$ is held above 6 kV to thereby ensure adequate firing of the spark plug.

Therefore, the secondary coil must have the secondary inductance $L_2$ and resistance $R_2$ that satisfy the lowest spark plug electrode voltage $V_2'$=6.0 kV at the time of load.

As expressed by equation (2) of $V_2$ described above, the primary voltage is limited by the Zener voltage and, consequently, the turns ratio of the ignition coil must be increased in order to increase the secondary voltage.

However, there is a limit to increasing the turns ratio by reducing the number of turns of the primary coil. The reason is that, if the number of turns of the primary coil are excessively reduced, the primary inductance becomes small, so that the secondary current becomes small as represented by the equation (3) and the secondary energy also decreases, as represented by the equation (4); the duration of arc discharge becomes short and deterioration of low temperature startability and spark blow-out are likely to occur.

Accordingly, in this embodiment, the secondary inductance $L_2$ at which the secondary current becomes maximal is determined, while determining the necessary and sufficient spark plug electrode voltage $V_2'$ from the equations (3) and (6), and the turns ratio of the primary coil and the secondary coil are found on the basis of the inductance $L_2$.

The rise characteristics of the primary current of the coil are determined by the equation (5). This embodiment sets the primary inductance to 2.1 mH and the primary; resistance $R_1$ to 0.5Ω so that the primary current may rise up to 8A within 2.2 msec.

Therefore, it is selected that the Darlington pair of power transistors 41 have a collector current capacity of at least 8A, and the Zener diode has a withstand voltage of at least 350 V.

As a result, the turns ratio a of the ignition coil that can satisfy at least the required voltage of 28 kV of the engine is 70. It can be understood from the equation (3) that 100 mA can be made the secondary current as given below:

$$I_2 \approx \frac{1}{70} \times 8[A] = 110 \text{ mA}$$

The prior art devices which put emphasis on the secondary voltage rely generally on the turns ratio. Thus, in the prior art, from the equation(3) (omitting k):

$$I_2 \approx \frac{1}{85} \times 6[A] = 70 \text{ mA}$$

where turns ratio a is 85 and primary current $I_1$ is 6A. Therefore, in the present invention, a secondary current improvement of 57% is attained.

Furthermore, when the withstand voltage of the Zener diode 5 is selected to be at least 400 V in the present invention, the turns ratio a becomes 64 from the equation (2):

$$a \approx \frac{V_2}{a \cdot V_Z} = \frac{28(\text{kV})}{1.1 \times 400(\text{V})} = 64$$

Therefore, the secondary current $I_2$ is given as follows from the formula (3):

$$I_2 \approx \frac{1}{64} \times 8[A] = 125 \text{ mA}$$

Accordingly, it can be understood that an improvement of about 80% with regard to secondary current can be attained in comparison with the prior art device.

From the results given above, performance can be improved drastically over the conventional device by setting the withstand voltage of the Zener diode to at least 350 V, the turns ratio between 60 and 70 and the primary current to at least 6A.

If power FETs or insulated gate bipolar transistors (IGBTs) are used instead of the Darlington pairs of power transistors, the effect obtained thereby is the same. When such semiconductor devices are used, there is the advantage that the power consumption of the driver can be lowered because the driving current can be drastically reduced. Furthermore, high breakdown voltage power drivers can be used.

The secondary inductance can be reduced by setting the turns ratio to 60–70 and reducing the primary inductance, and the rise speed of the secondary current can also be increased. Accordingly, a device having improved startability and high spark blow-out resistance can be obtained in combination with improvement in secondary current. As shown from FIGS. 9(*a*) through 9(*f*) representing the secondary voltage and secondary current of a prior art device, it will be noted at 2000 r.p.m. when the spark plug fires the secondary voltage momentarily drops but thereafter remains relatively constant at an engine speed of 2000 r.p.m. and air-fuel ratio of 13. However, when the engine speed increases to 3000 r.p.m. and the air-fuel ratio becomes slightly leaner at 12.6 then about 500 μsec after firing the secondary voltage undergoes a disturbance indicating the effects of cylinder induction. At 4000 r.p.m. and an air-fuel ratio of 12 it will be noted that approximately 400 μsec after firing the spark is blown out. When the speed is increased to 6000 r.p.m. and the air-fuel ratio is 10.8, blow-out occurs immediately after firing and so no combustion occurs. The comparable characteristics are shown for the present invention in FIGS. 9(*a*) through 9(*l*) in which it will be seen that at 6000 r.p.m., although blow-out does occur, it is delayed for 300 μsec which provides an opportunity for combustion and burning of gas to occur prior to blow-out. Therefore, the present invention is capable of producing a cleaner emission.

The secondary inductance $L_2$ is given by the following equation (7):

$$L_2 = a^2 L_1 \tag{7}$$

$L_2$:secondary inductance
$L_1$:primary inductance
a:turns ratio

Generally, $L_1$ is 6 mH to 9 mH, but 2 mH to 5 mH can be used for DIS (Direct Ignition System) having a small number of distribution ports P1 to P6 and a great beneficial effect can be exhibited.

Various dimensions thus determined are tabulated below.

| | Power switch | | | | Ignition Coil | | | | | spark plug electrode voltage | secondary current |
|---|---|---|---|---|---|---|---|---|---|---|---|
| | primary current $I_1$ | primary current $V_1$ | turns ratio a | coupling coefficient k | $L_1$ | $R_1$ | $L_2$ | $R_2$ | $C_2$ | $V_2$ | $I_2$ |
| Present Embodiment | 8 A | 350 V | 65 | 0.9 | 2.1 mH | 0.5Ω | 9 H | 4.7k Ω | 25 pF | 8.4 kV at the time of smoldering 28 kV | max. value |
| Prior art example | 6 A | 310 V | 85 | 0.9 | 2.1 mH | 0.7Ω | 15 H | 8.5k Ω | 35 pF | ordinarily the greater the better | not considered |

Hereinafter, detailed analysis will be made using the tabulated values.

The rise time of the ignition spark voltage $V_2$ induced in the secondary winding of the ignition coil (hereinafter referred to as the "rise time") is determined by the frequency f of the ignition spark voltage $V_2$ induced in the secondary winding due to cut-off of the excitation circuit of the primary winding of the ignition coil. The higher the frequency, the shorter the rise time.

The ignition spark voltage $V_2$ induced in the secondary winding changes essentially sinusoidally and, consequently, its frequency is equal to the inverse number of the product of $2\pi$ by the square root of the product of the secondary inductance $L_2$ by the secondary capacitance $C_2$, as expressed by the following equation:

$$f = \frac{1}{2\pi\sqrt{L_2 \cdot C_2}} \text{ Hz} \tag{8}$$

The secondary inductance $L_2$ consists of the inductance of the secondary winding of the ignition coil and a negligible extremely-small inductance of the spark plug lead. Therefore, the inductance value of the secondary winding can be regarded as the secondary inductance $L_2$. The secondary capacitance $C_2$ consists of the capacitance of the winding intermediate layer of the secondary winding of the ignition coil, the capacitance of the spark plug lead, the spark plug capacitance and other stray capacitances. Therefore, the value of the secondary capacitance $C_2$ is essentially constant in any ignition device and it is 25 pF ($25\times10^{-12}$ farads) in the case of DIS. For this reason, in order to increase the frequency of the ignition spark voltage $V_2$ induced in the secondary winding of the ignition coil, the secondary winding inductance $L_2$ of the ignition coil must be reduced. The period of ignition arc which will be hereinafter referred to as the "arc period" is determined by the energy Wp stored in the primary coil of the ignition coil. The greater the stored energy, the longer the arc period. The energy Wp stored in the primary winding of the primary coil is equal to ½ of the product of the primary winding inductance $L_1$ times the square of the primary current $I_1$ as can be expressed by the following equation:

$$Wp = \frac{L_1(I_1)^2}{2} \text{ joules} \tag{9}$$

The maximum quantity of the primary current $I_1$ is determined by the capacity of the primary winding for passing and cutting off the current. Accordingly, the primary winding inductance $L_1$ should be selected so as to obtain the stored energy Wp necessary for generating a predetermined arc period of the maximum primary winding excitation current $I_1$. The inductance $L_2$ of the secondary winding of the ignition coil is equal to the product of the inductance $L_1$ of the primary winding of the ignition coil and the square of the turns ratio $N_2/N_1$ of the primary coil and the secondary coil which is referred to herein as the "turns ratio", as expressed by the aforementioned equation (7).

It is obvious from the equation (7) that the smaller the turns ratio, the smaller the value of the secondary winding inductance $L_2$ and from the equation (8) that the smaller the secondary winding inductance $L_2$, the lower is the frequency of the ignition spark voltage $V_2$ induced in the secondary winding of the ignition coil. In other words, the ignition coil which should be used in the ignition device of the present invention must have a primary coil having an inductance value sufficient to store the energy Wp capable of providing a desired arc period created by maximum power feed current determined by the capacity of the excitation circuit switch device to pass and cut off the current and must have a turns ratio small enough to provide a desired rise time.

In any ignition device, constant parameters are (a) the maximum ignition coil primary current which is determined by the capacity of the ignition coil primary winding excitation circuit switch device to pass and cut off the current, and (b) the maximum primary voltage $V_1$ which is determined by the highest voltage which is when the switch device operates to cut off thereby cutting off the primary current. In order to explain the steps for manufacturing the ignition coil suitable for use as part of the ignition device of the present invention, it will be assumed that the capacity of the Darlington pair of power transistors 41–46 to pass and cut off the largest current is 8A and the maximum primary voltage $V_1$ at the time of cut-off of the highest voltage applied to the collector-emitter electrodes is 350 V. Furthermore, it will be assumed that a desired rise time of the ignition spark voltage $V_2$ induced in the secondary coil from zero (0)V to 28 kV is 40 μsec and the arc period is 700 μsec. The ignition spark voltage $V_2$ induced in the secondary coil when the excitation circuit of the ignition coil primary coil is cut off is proportional to the product of the primary voltage by the turns ratio as expressed by the above equation (2).

The maximum primary voltage $V_1$ which the Darlington power of transistors can withstand without being damaged or broken-down is at least 350 V. Therefore, when the turns ratio $N_2/N_1$ is solved by substituting 28 kV for $V_2$ and 400 V for $V_2$ in the equation (2), the turns ratio of the ignition coil 11 becomes approximately 64:1, assuming the load coefficient $\propto$ is approximately 1.1.

The primary coil has the inductance value $L_1$. If the maximum primary current of the ignition coil is 8A and has sufficient storage energy Wp, there can be calculated the ionization energy $w_i$ necessary for ionizing the arc gap of the spark plug where the spark arc occurs, the arc duration energy $w_a$ necessary for keeping this arc for 700 μsec and ignition coil (ion) loss energy $w_e$ necessary for compensating for the energy loss of the ignition coil. The ionization energy $w_i$ and the arc duration energy $w_a$ are determined by the following equations:

$$wi = \frac{(E_i)^2 \cdot C_2}{2} \text{ joules} \tag{10}$$

$$w_a = \frac{(E_a\, I_2 \text{ (arc period)}}{2} \text{ joules} \tag{11}$$

where $E_i$:voltage necessary for ionizing arc gap of each spark plug and generating arc $C_2$:secondary capacitance $E_a$:a voltage necessary for keeping spark arc $I_2$:secondary current expressed by ampere (A)

In the present embodiment, the secondary capacitance is 25 pF ($25\times10^{-12}$ farad), the voltage $E_i$ necessary for ionizing the arc gap of each spark plug and generating the spark arc is 15 kV, the voltage $E_a$ necessary for keeping the arc is 1.2 kV and the ignition coil energy $w_i$ loss is about 0.4 of the secondary coil energy $w_s$.

As expressed by the equation (3), the secondary current $I_2$ can be obtained by dividing the primary current $I_1$ by the turns ratio and multiplying the result by a coupling coefficient of about 0.9.

When 8A is substituted for $I_1$ and 64 for a in the equation (3), the secondary current $I_2$ is about 110 mA.

The predetermined ionization energy $w_i$ is determined by substituting 28 kV for $E_i$ in the equation (10) and 25 pF for $C_2$. When the ionization energy $w_i$ is solved, the ionization energy $w_i$ necessary for ionizing the arc gap of each spark plug and generating the spark arc is found to be 10.125 millijoules.

In order to determine the predetermined arc duration energy $w_a$, 110 mA is substituted for $I_2$ in the equation (11) and 700 μsec for the arc period. When the arc duration energy $w_a$ is solved, the arc duration energy $w_a$ necessary for keeping the arc for 700 μsec is found to be 46.2 millijoules. The predetermined total secondary energy $w_s$ is the sum of the ionization energy $w_i$, the arc duration energy $w_a$ and the loss energy wl, as expressed by equation (12).

$$w_s = w_i + w_a + w_l \text{millijoules} \tag{12}$$

If 10.125 millijoules, 46 millijoules and $w_l=(0.4\ w_s)$ are substituted for $w_i$, $w_a$ and $w_l$ of the equation 12, respectively, the loss energy $w_s$ is 93.54 millijoules.

In the present embodiment, the conversion of energy from the primary coil to the secondary coil is about 70%. Therefore, the predetermined primary energy $w_p$ stored in the primary coil is determined by the following equation:

$$w_p = \frac{w_s}{0.7} \text{ millijoules} \tag{13}$$

When the primary coil energy $w_p$ is solved by substituting 93.54 millijoules for the secondary energy $w_s$, the predetermined coil energy $w_p$ is 133.6 millijoules.

The inductance $L_1$ of the primary coil can be obtained by dividing the primary winding energy $w_p$ by the square of the primary current $I_1$ and doubling the result:

$$L_1 = \frac{w_p}{(I_1)^2} \times 2 \text{ millihenry} \tag{14}$$

When the primary coil inductance $L_1$ is solved by substituting 133.6 millijoules for the primary coil energy $w_p$ of the equation (14) and 8A for the primary current $I_1$, the primary inductance $L_1$ necessary for generating the energy $w_p$ which is sufficiently stored in the primary coil by the maximum excitation current of 8A so as to obtain the arc duration of 700 milliseconds is 4.175 mH, that is, about 4 mH.

As expressed by the equation (7), the secondary inductance $L_2$ is equal to the product of the primary inductance $L_1$ by the square of the turns ratio.

When the secondary inductance is solved by substituting 4 mH calculated from equation (14) for the primary inductance $L_1$ in the equation (7) and 65 for the turns ratio, the secondary inductance $L_2$ is 16.9 mH.

When the equation (8) is solved by substituting 16.9 mH for $L_2$ derived from the equation (7) and 25 pF ($25\times10^{-12}$ farads) for $C_2$ in order to calculate the frequency f of the ignition spark voltage $V_2$ induced in the secondary coil of the ignition coil due to cut-off of the primary current, the frequency induced in the secondary coil is 7,752 Hz and hence, the period of each cycle (1/f) is 129 μsec. Since the voltage induced in the secondary coil of the ignition coil reaches the maximum at 90° of each cycle, the voltage induced in the secondary coil reaches the peak value at 32 μsec corresponding to 129/4 μsec.

The maximum voltage $E_a$ exhibited by the secondary coil of the ignition coil can be expressed by the following equation:

$$E_a^2 = \frac{2w_s}{c_2} \text{ kV} \tag{15}$$

When an effective voltage $E_a$ is solved by substituting 93.54 for $w_s$ and 25 pF ($25\times10^{-12}$ farads) for $C_2$, the effective voltage or the peak voltage obtained by the secondary coil is about 28 kV. Since the voltage induced in the secondary coil is substantially a sinusoidal wave, the values of 30°, 45° and 60° of this induced voltage can be calculated by multiplying the maximum effective voltage $E_a$ by the sines of 30°, 45° and 60°, respectively.

Figure 10:
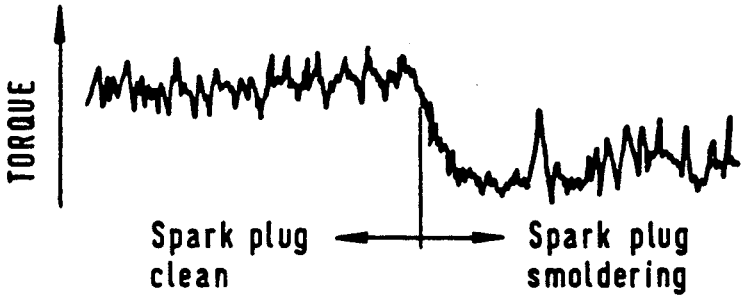
FIG. 10 shows the result of analysis of abnormality of the engine due to spark plug smoldering.
Figure 11:
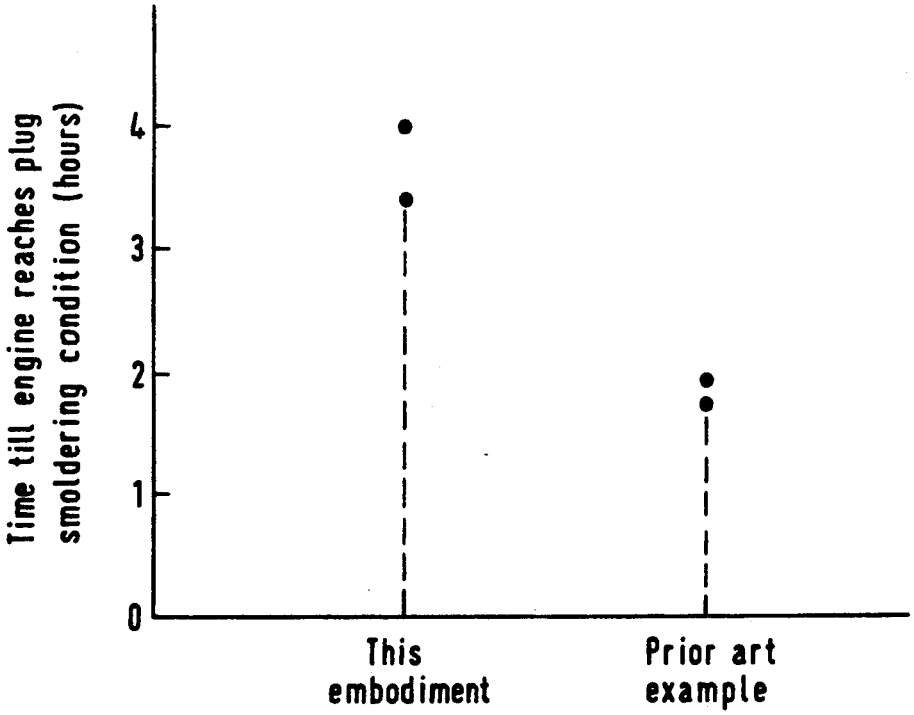
FIG. 11 shows in graphical form the advantageous effect of the present invention.

The effects of a smoldering, that is badly carbonized spark plug, is shown in FIG. 10 where for a constant engine speed, air-fuel ratio and water temperature, the torque is severely reduced when the plug is smoldering. FIG. 11 shows that when the engine has a smoldering plug, the time for the engine to reach a bad condition where the torque is sharply reduced is doubled by the present invention over the prior art where two sets of samples are indicated for each of the prior art and present invention.

Since the present invention can greatly increase the secondary current of the ignition coil, it can also improve low temperature startability and can provide excellent combustion reducing blow-out at the time of high speed revolution or when swirl is strong.

It is to be understood that the invention has been described with reference to exemplary embodiments, and modifications may be made without departing from the spirit and scope of the invention as defined in the appended claims.

We claim:

1. An induction discharge system ignition device for an internal combustion engine including means for producing a voltage to be applied to a coil primary winding, means for applying an output of said coil to a fuel ignition means, wherein said means for producing a voltage and said coil produce a voltage of at least 6.0 kV across the electrodes of the ignition means when said ignition means has a leakage resistance of 100 kΩ.

2. A device as claimed in claim 1 wherein said producing means includes a predetermined turns ratio of secondary to primary windings of said coil.

3. A device as claimed in claim 2 wherein said turns ratio is 70 or less.

4. A device as claimed in claim 3 wherein said turns ratio is 70 when the voltage producing means provides a voltage of at least 350 V across said primary winding.

5. A device as claimed in claim 2 wherein said turns ratio is the square root of the secondary winding inductance divided by the primary winding inductance.

6. A method of operating an induction discharge system ignition device for an internal combustion, said device including means for producing a voltage applied to a coil primary winding, means for applying an output of said coil to a fuel ignition means, wherein said voltage producing means and said coil produce at least 6.0 kV across the electrodes of the ignition means when said ignition means has a leakage resistance of 100 kΩ.

7. A method as claimed in claim 6 wherein said producing means includes a predetermined turns ratio of secondary to primary windings of said coil.

8. A method as claimed in claim 7 wherein said turns ratio is 70 or less.

9. A method as claimed in claim 8 wherein said turns ratio is 70 when the voltage producing means provides a voltage of at least 350 V across said primary winding.

10. A method as claimed in claim 9 wherein said turns ratio is the square root of the secondary winding inductance divided by the primary winding inductance.

11. An induction discharge system ignition device for an internal combustion engine comprising:

an ignition coil having a primary coil and a secondary coil;

means for inducing a voltage to be applied to the primary coil of said ignition coil;

means for applying an output of the secondary coil of said ignition coil to a fuel ignition means;

wherein the voltage of said voltage inducing means, turn ratio of the secondary to primary coils of said ignition coil, the secondary resistance, and the secondary inductance of the secondary coil of said ignition coil are selected so as to produce a voltage of at least 6.0 kV across the electrodes of the ignition means when said ignition means has a leakage resistance of 100 kΩ.

12. An induction discharge system ignition device for an internal combustion engine comprising:

an ignition coil having a primary coil and a secondary coil, said primary coil being connected to a voltage supply without a capacitor and the turn ratio of the secondary to primary coils of said ignition coil being selected in a range of 60 to 70;

means for inducing a voltage of at least 350 V to be applied to the primary coil of said ignition coil;

means for applying an output of the secondary coil of said ignition coil to a fuel ignition means;

wherein, the primary current of the ignition coil, the secondary resistance, and the secondary inductance of the secondary coil of said ignition coil are selected so as to produce a voltage of at least 6.0 kV across the electrodes of the ignition means when said ignition means has a leakage resistance of 100 kΩ.

* * * * *